US011732558B2

(12) United States Patent
Boyd et al.

(10) Patent No.: US 11,732,558 B2
(45) Date of Patent: Aug. 22, 2023

(54) FASTENING APPARATUS, SYSTEM, AND METHOD

(71) Applicant: FLOWCO PRODUCTION SOLUTIONS, LLC, Spring, TX (US)

(72) Inventors: Garrett S. Boyd, Granbury, TX (US); Mitchell A. Boyd, Haslet, TX (US)

(73) Assignee: FLOWCO PRODUCTION SOLUTIONS, LLC, Spring, TX (US)

( * ) Notice: Subject to any disclaimer, the term of this patent is extended or adjusted under 35 U.S.C. 154(b) by 106 days.

(21) Appl. No.: 17/511,883

(22) Filed: Oct. 27, 2021

(65) Prior Publication Data

US 2023/0131997 A1 Apr. 27, 2023

(51) Int. Cl.
*E21B 43/12* (2006.01)
*F04B 47/12* (2006.01)

(52) U.S. Cl.
CPC ..... *E21B 43/121* (2013.01); *F04B 47/12* (2013.01)

(58) Field of Classification Search
CPC ..... E21B 43/121; F04B 47/12; F16L 13/141; F16B 11/002; B25B 27/10; B21D 39/048
See application file for complete search history.

(56) References Cited

U.S. PATENT DOCUMENTS

| | | | | |
|---|---|---|---|---|
| 7,240,606 | B2 * | 7/2007 | Andersen, Jr. | F15B 15/1447 92/169.1 |
| 7,516,990 | B2 * | 4/2009 | Jamison | F16L 13/141 285/256 |
| 9,932,805 | B2 * | 4/2018 | Kuykendall | E21B 43/121 |
| 10,550,674 | B2 * | 2/2020 | Boyd | F04B 47/12 |
| 10,632,517 | B2 * | 4/2020 | Teramoto | B21D 39/048 |
| 10,669,824 | B2 * | 6/2020 | Boyd | F04B 53/129 |
| 2016/0115769 | A1 * | 4/2016 | Kuykendall | E21B 43/121 166/153 |
| 2016/0237795 | A1 * | 8/2016 | Xiqing | E21B 43/121 |

* cited by examiner

*Primary Examiner* — Thomas E Lazo
(74) *Attorney, Agent, or Firm* — FisherBroyles, LLP; Jason P. Mueller

(57) ABSTRACT

A downhole tool includes a body having a rounded or cylindrical surface, at least one relieved space in the rounded or cylindrical surface, and a protuberance within the relieved space. The downhole tool also has a generally cylindrical retaining ring that surrounds a portion of the body. One or more crimple detents are formed in the retaining ring, each crimple detent comprising a portion of the retaining ring that has been deformed radially inward into an underlying portion of the relieved space such that the deformed material of the retaining ring contacts and deforms an underlying portion of the protuberance in the relieved space, thereby joining the retaining ring to the body.

13 Claims, 8 Drawing Sheets

FASTENING APPARATUS, SYSTEM, AND METHOD

BACKGROUND

The present disclosure generally relates to apparatuses, systems, and methods for fastening a first body to a second body, and more particularly to improved apparatuses, systems, and methods for fastening a first body to a second body by deforming an outer surface of the second body into a relieved space of the first body and deforming a protuberance on the first body that is located within the relieved space.

BRIEF DESCRIPTION OF THE DRAWINGS

The accompanying drawings are part of the present disclosure and are incorporated into the specification. The drawings illustrate examples of embodiments of the disclosure and, in conjunction with the description and claims, serve to explain various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein.

DETAILED DESCRIPTION

Figure 1:
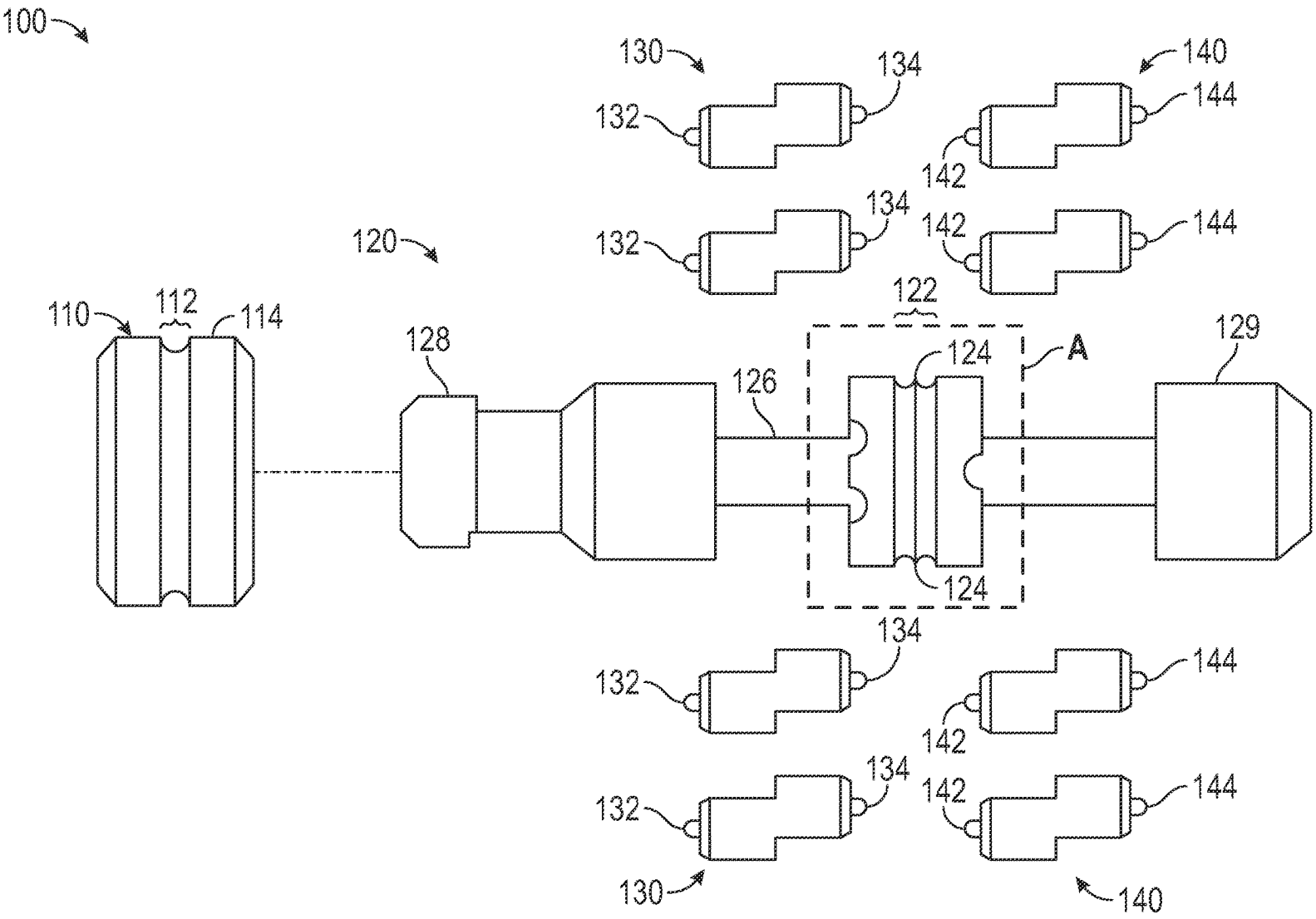
FIG. 1 illustrates an exploded view of a first embodiment of a downhole tool.

In one aspect, the present disclosure provides apparatuses, systems, and methods for fastening a first body to a second body by crimpling an outer surface of the second body into a relieved space of the first body and deforming a protuberance located on the first body within the relieved space. Exemplary embodiments of the present disclosure provide numerous benefits, including simpler manufacturing and potential reduction of manufacturing costs as compared to use of threaded components, and enhanced performance, durability, and reliability for downhole tools.

Exemplary embodiments of the present disclosure include a downhole tool, such as a bypass plunger, as disclosed herein. The tool may be a unibody dual pad bypass plunger that includes a hollow plunger body, a retaining ring, and pads. Other examples of downhole tools that may include embodiments of the present disclosure include packoffs and bumper springs.

One exemplary conventional bypass plunger is a device that is configured to freely descend and ascend within tubing of a well (e.g., an oil well or a gas well), typically to restore production to a well having insufficient pressure to lift the fluids in the well to the surface. A bypass plunger may include a self-contained valve—also called a "dart" or a "dart valve" in some instances—to control the descent and ascent of the plunger. Typically, the valve is opened to permit flow of fluids in the well through the valve and passages in the plunger body as the plunger descends through the well. Upon reaching the bottom of the well, the valve is closed, blocking the passages that allow fluids to flow through the plunger and converting the plunger into a piston. With the plunger converted to a piston, the upward flow of fluids or gas is blocked, and the residual pressures in the well increase to the point that the pressure is high enough to lift the plunger and the volume of fluid above it toward the surface. As the plunger rises, it pushes fluid upward into a conduit on the surface for recovery. When the plunger reaches the surface, a valve in the plunger is opened by a striker mechanism and the plunger thereafter descends to the bottom of the well to repeat the cycle.

While generally effective in lifting accumulated fluids and gas of unproductive wells, conventional bypass plungers tend to be complex and suffer from reliability problems in an environment (e.g., downhole) that subjects the bypass plungers to high impact forces, caustic fluids, and elevated temperatures. While attempts to simplify construction of bypass plungers and other downhole tools, to improve reliability and performance, and to reduce the cost of manufacture have been proposed, failures remain common and a need exists to eliminate the causes of these failures.

In at least one embodiment, a downhole tool is provided comprising a unitary body having a rounded or cylindrical surface, at least one relieved space in the rounded or cylindrical surface, and a protuberance within the relieved space. The downhole tool can also include one or more pads A retaining ring retains the tabs of the pads. One or more deformations or crimples formed in the retaining ring extend inward along corresponding radii of the retaining ring. This causes the material of the retaining ring to be pushed into a corresponding relieved space on the unitary body, and the inwardly extending material of the retaining ring in turn deforms a protuberance located within the relieved space to help join the retaining ring to the unitary body.

In the appended drawings, reference numbers that appear in more than one figure refer to the same structural feature. The drawings depict at least one example of each embodiment or aspect to illustrate the features of the present disclosure and are not to be construed as limiting the disclosure thereto. The term "plunger dart" or simply "dart" may also be named a poppet valve or a valve dart herein, all of which refer to the same component.

FIG. 1 illustrates an exploded view of a first embodiment of a downhole tool 100 according to the disclosure. The downhole tool 100 includes a body 120, a central body 126, a retaining ring 110, first pads 130, second tabs 140, a retaining nut 128 and an end nut 129. The central body 126, the retaining nut 128, the end nut 129, the retaining ring 110, and the first and second pads 130/140 may be machined from a suitable material, such as stainless steel alloy. The central body 126 may include a relieved area 122 having a protuberance 124 therewithin. The protuberance may form a single concentric ring around the central body within the relieved space 122. The retaining ring 110 may have a concentric groove 112 formed in an outer surface 114 of the retaining ring 110. The first pads 130 may have tabs 132 and 134 at each end. Likewise, the second pads 140 may have tabs 142 and 144 at each end.

In at least one exemplary method, the downhole tool 100 may be assembled by first affixing the end nut 129 to the central body 126. Next, the second pads 140 may be placed next to the central body 126, with the tabs 144 of the second pads 140 placed under a portion of the end nut 129 (shown in cross-section in FIG. 3B). The retaining ring 110 may be slipped over the end of the central body 126 opposite the end nut 129. The pads 140 may be placed next to the central body 126, with tabs 142 of the second pads being located under a first inner end of the retaining ring 110 (see FIG. 3B).

The retaining ring 110 may now be crimped at one or more places along the groove 112 to deform portions of the retaining ring 110 and corresponding portions of the protuberance 124 underlying the deformed portions of the retaining ring 110. Deforming a portion of the retaining ring 110 and an underlying portion of the protuberance 124 is hereinafter referred to as forming a "crimple." Forming such a crimple helps to firmly join the retaining ring 110 to the central body 126.

Figure 3A:
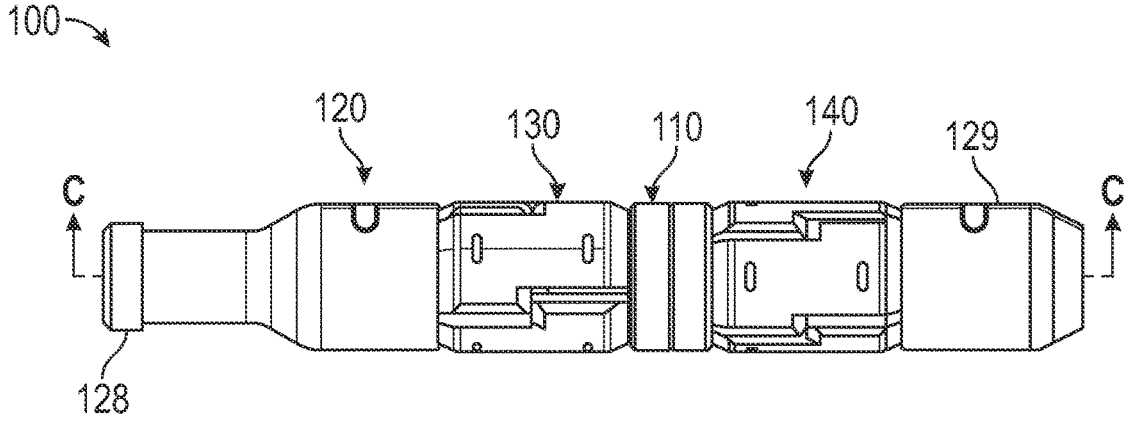
FIG. 3A is a view of the downhole tool of FIG. 1 in an assembled condition.
Figure 3B:
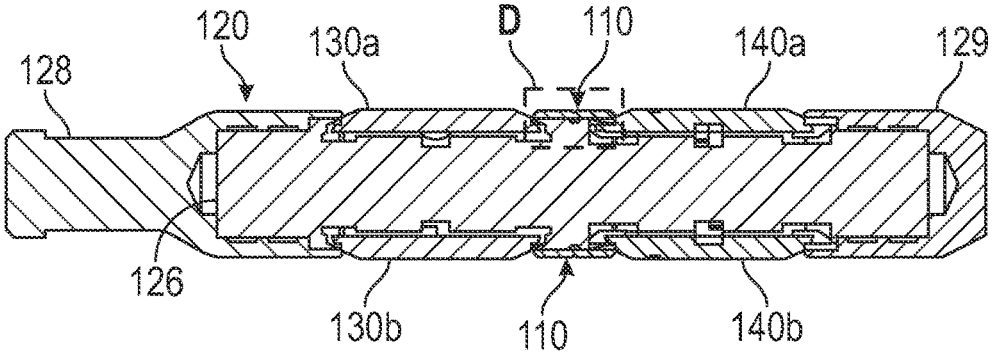
FIG. 3B is a cross-sectional view of the downhole tool of FIG. 3A.

The first pads 130 may then be placed next to the central body 126, with tabs 134 of the first pads 130 being located under a second inner end of the retaining ring 110 (see FIG. 3B). The retaining nut 128 may then be affixed to the central body 126, with tabs 132 of the first pads 130 being located under an inner end of the retaining nut 128.

One or more crimples 410*a*, 410*b*, 410*c*, and 410*d* (described in detail hereinbelow with reference to FIGS. 4A, 4B, and 4C) may be formed in the groove 112 around the circumference of the retaining ring 110. The crimple(s) 410*a*, 410*b*, 410*c*, and 410*d* provide a mechanism to lock the retaining ring 110 on to the central body 126, thereby preventing the retaining ring 110 from rotating or wiggling on the central body 126. Affixing the retaining ring 110 to the central body 126 with the crimple(s) 410*a*, 410*b*, 410*c*, and 410*d*, and preventing the retaining ring 110 from moving with respect to the central body 126 helps to reduce wear on the retaining ring 110 that is associated with the retaining ring 110 moving (e.g., rotating or wiggling) with respect to the central body 126.

Figure 2A:
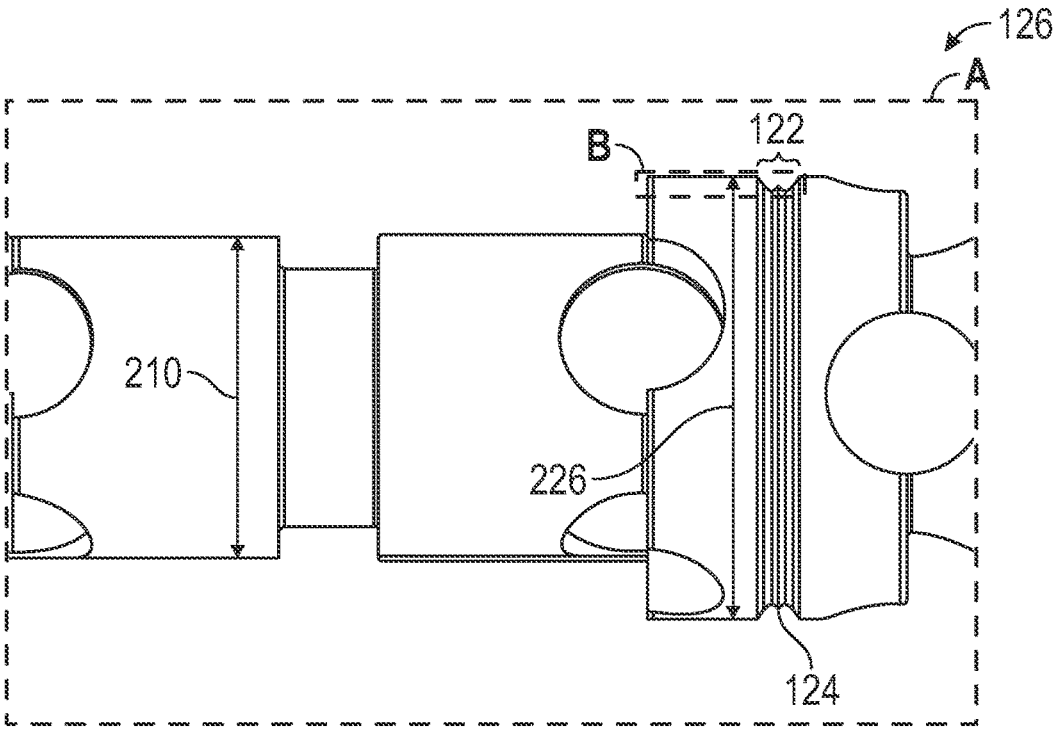
FIG. 2A is a view of the central body of the downhole tool of the first embodiment.

FIG. 2A is a view of the central body 126 indicated at A in FIG. 1. The diameter of the thinner portion of the central body 126 may, for example, be in the range of 0.5 to 2 inches. The diameter of the larger portion of the central body 126 containing the relived area 122 and the protuberance 124 may, for example, be in the range 1 to 2.25 inches.

Figure 2B:
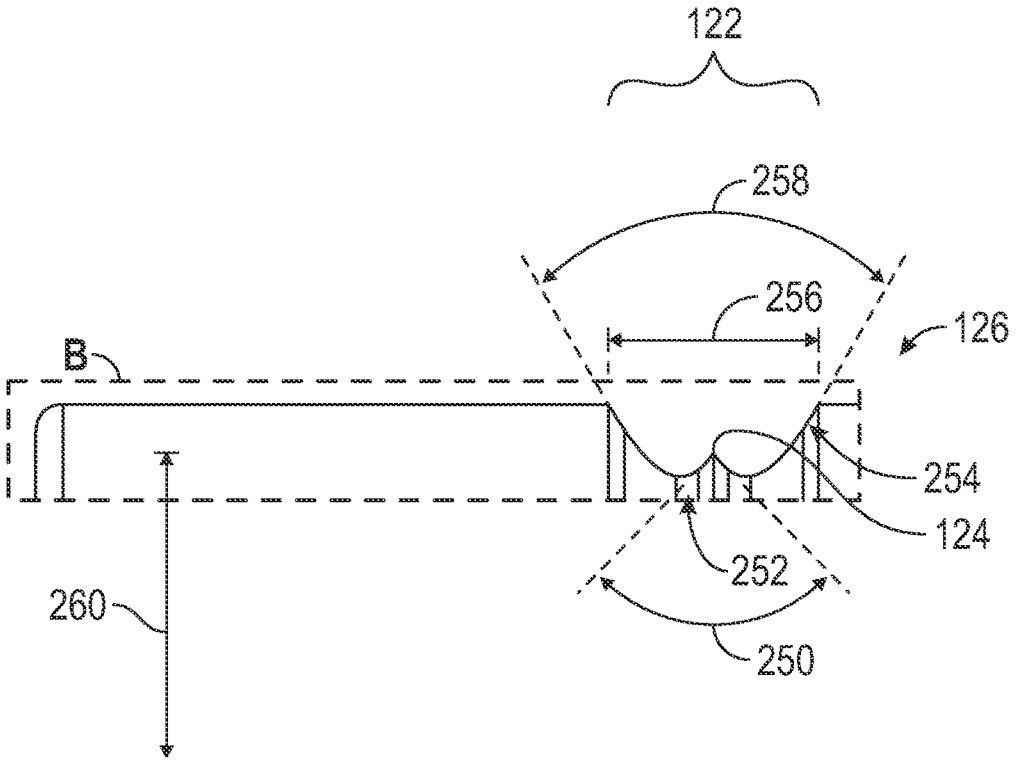
FIG. 2B is an enhanced view of a portion of the central body of the downhole tool of FIG. 2A.

FIG. 2B is an enhanced view of a portion of the larger diameter portion of the central body 126 that includes the relived area 122 and the protuberance 124, as indicated at B in FIG. 2A. The width 256 of the relieved space 122 may be between 0.1 and 0.2 inches. The protuberance 124 may, for example, be a sharp point, a small radius (e.g., 0.001 to 0.008 inches), or a small flat 0.001 to 0.01 inches wide. The angle 250 between the two sides of the protuberance 124 may, for example, be in a range of 40° to 135°. An angle that is too small may cause cracking to occur in the protuberance 124 when the crimple is formed. An angle that is too large may cause the protuberance 124 to spring back when the crimple is formed, which may result in the retaining ring 110 not being firmly affixed to the central body 126, which would allow the retaining ring to move relative to the central body 126. As noted above, this can cause wearing and ultimately failure of the downhole tool.

The transition from the sides of the protuberance may have a radius 252 in a range of 0.005 to 0.025 inches. The transition, from the radius 252 to the sides of the relieved space 122, may have a radius 254 in a range of 0.010 inches to 0.1 inches. The sides of the relieved space 122 may be formed at an interior angle 258 having a range of 40° to 120°. Of course, all of these dimensions are only examples that would apply to a downhole tool as described. Alternate embodiments of a downhole tool that make use of the disclosed methods of forming crimples could have alternate dimensions.

FIG. 3A is a view of the downhole tool 100 in an assembled condition. FIG. 3A shows downhole tool 100, retaining ring 110, single body 120, first pads 130, second pads 140, retaining nut 128 and end nut 129. When assembled, tabs 132 of the first pads 130 are positioned under a portion of retaining nut 128. Similarly, the tabs 144 of the second pads 140 are positioned under a portion of the end nut 129. The tabs 134 of the first pads 130 and the tabs 142 of the second pads 140 are positioned under the retaining ring 110.

FIG. 3B is a cross-sectional view of the downhole tool 100 taken along section line C-C in FIG. 3A. As shown, the first pads 130 are shown in the cross-section with an upper portion 130*a* and a lower portion 130*b*. Similarly, the second pads 140 are shown in the cross-section with an upper portion 140*a* and a lower portion 140*b*.

Figure 3C:
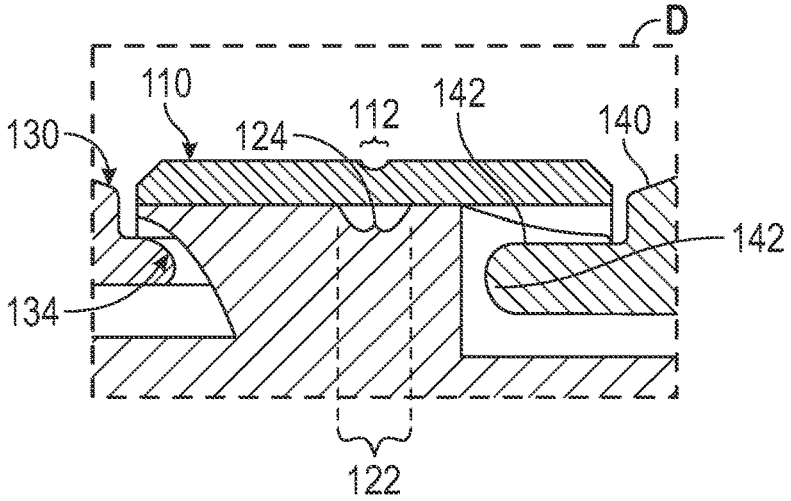
FIG. 3C is an enhanced view of a portion of the downhole tool of FIG. 3A.

FIG. 3C is a detail of the portion of the downhole tool 100 shown at D in FIG. 3B. As shown, the groove 112 of the retaining ring 110 is above the relieved space 122 of the central body 126, when the downhole tool is assembled. Also, tabs 134 of the first pads 130 are beneath a first inner end of the retaining ring 110, and tabs 142 of the second pads 140 are beneath the second inner end of the retaining ring 110. Thus, the first pads 130 and second pads 140 are retained by the retaining ring 110, when the downhole tool is assembled.

Figure 4A:
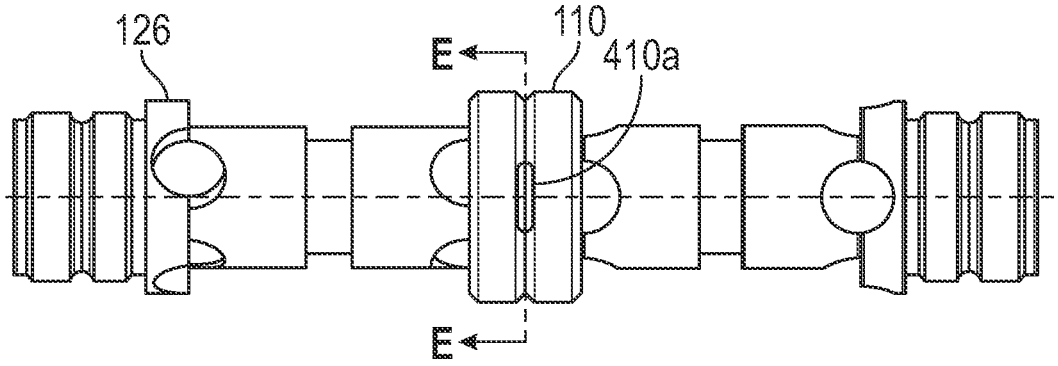
FIG. 4A is a view of the downhole tool of FIG. 1 with pads, retaining nut, and end nut removed to expose the central body.

FIG. 4A is a view of the downhole tool 100 with first pads 130, second pads 140, retaining nut 128 and end nut 129 removed to expose central body 126. Retaining ring 110 has been deformed/crimped, with one crimple visible at 410*a*.

Figure 4B:
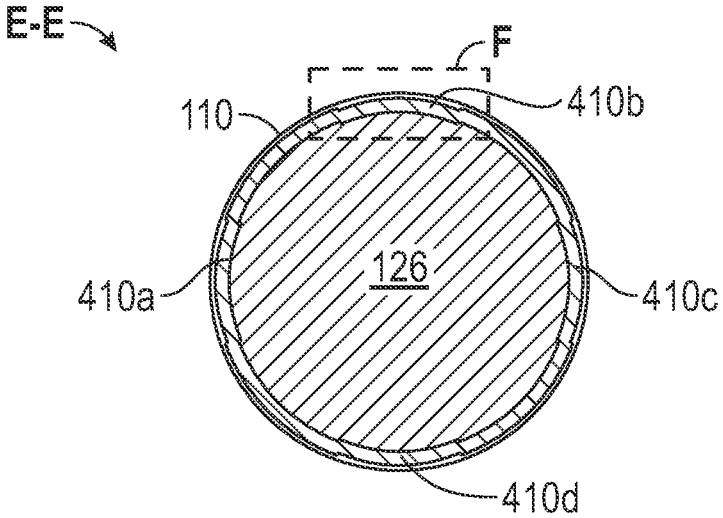
FIG. 4B is a cross-sectional view through the central body and retaining ring of the downhole tool of FIG. 4A.

FIG. 4B is a cross-sectional view through the central body 126 and retaining ring 110 taken along section line E-E in FIG. 4A. As illustrated, the retaining ring 110 has been crimped at four locations, forming four crimples 410*a*, 410*b*, 410*c*, and 410*d* with the central body 126.

Figure 4C:
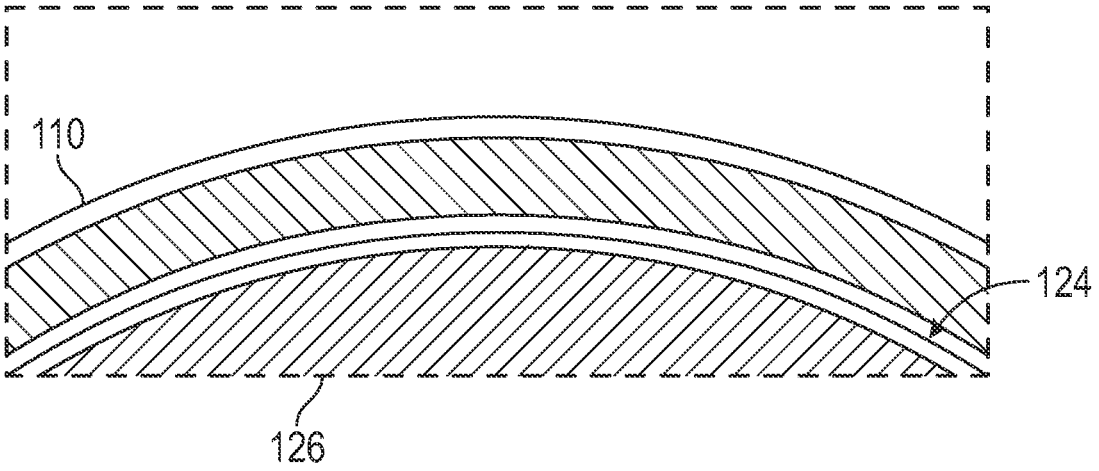
FIG. 4C is an enhanced view of a portion of FIG. 4B before a crimple is formed.

FIG. 4C is an enhanced view of a portion of FIG. 4B indicated at F before the crimples are formed. As illustrated, the protuberance 124 extends upward from the central body 126. The retaining ring 110 surrounds the central body and the protuberance, with a gap formed between the inner surface of the retaining ring 110 and the outer, upper edge of the protuberance.

Figure 4D:
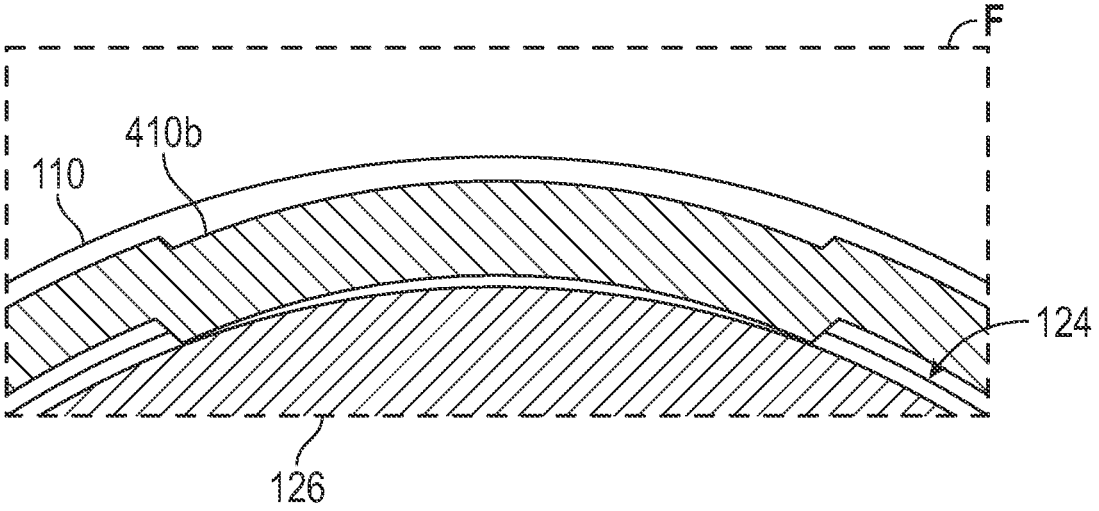
FIG. 4D is an enhanced view of a portion of FIG. 4B after a crimple is formed.

FIG. 4D is an enhanced view of a portion of FIG. 4B indicated at F after the crimple 410*b* has been formed. The protuberance 124 still extends upward from the main body 126 on both sides of the crimple 410*b*. Because the crimping of the retaining ring 110 deforms the retaining ring 110 radially inward, the material of the retaining ring crushes into the protuberance 124, locking the retaining ring 110 to the central body 126. This prevents the retaining ring 110 from moving with respect to the central body 126.

A crimple as disclosed herein eliminates the need for threads or separate parts, such as pins, screws, ball detents, lock nuts or washers, to lock a retaining ring or other part and onto a central body, to thereby prevent the retaining ring or other part from loosening or moving with respect to the central body. An advantage of the crimple technique and mechanism is to more reliably prevent the inadvertent disassembly of the components secured to the downhole tool, thereby ensuring a true unibody downhole tool (e.g., a bypass plunger) that remains a single unit throughout many cycles of use. In exemplary embodiments, the term crimple is a crimp and/or dimple that may approximate a crimp at a defined point as opposed to a complete circumferential crimp.

In the disclosed embodiment, a portion of the retaining ring 110 is deformed so that it engages and deforms an underlying portion of a circular protrusion 124 formed in the relieved area 122 on the main body, this structure comprising a crimple. This type of deformation can be superior to forming a crimp or deformation that presses a portion of the retaining ring 110 into underlying threads on the main body 126. For example, the circular protrusion 124 could have physical characteristics that are undesirable for threads, but which help to better affix the retaining ring 110 to the main body 126 when the crimple is formed. This could include forming the circular protrusion 124 to have a higher height than a corresponding threaded portion, or forming the circular protrusion 124 so that it is easier to deform and/or will better affix the retaining ring 110 to the main body when the crimple is formed.

Also, it may be easier and less expensive to form a single circular protrusion 124 on the main body 126, as opposed to forming threads on the main body 126. For example, it may be possible to cast the main body so that it includes a single circular protrusion 124, as opposed to performing a machining operation to form threads.

Also, while the disclosed embodiment includes only a single circular protrusion 124, alternate embodiments could include additional circular protrusions 124.

Figure 5:
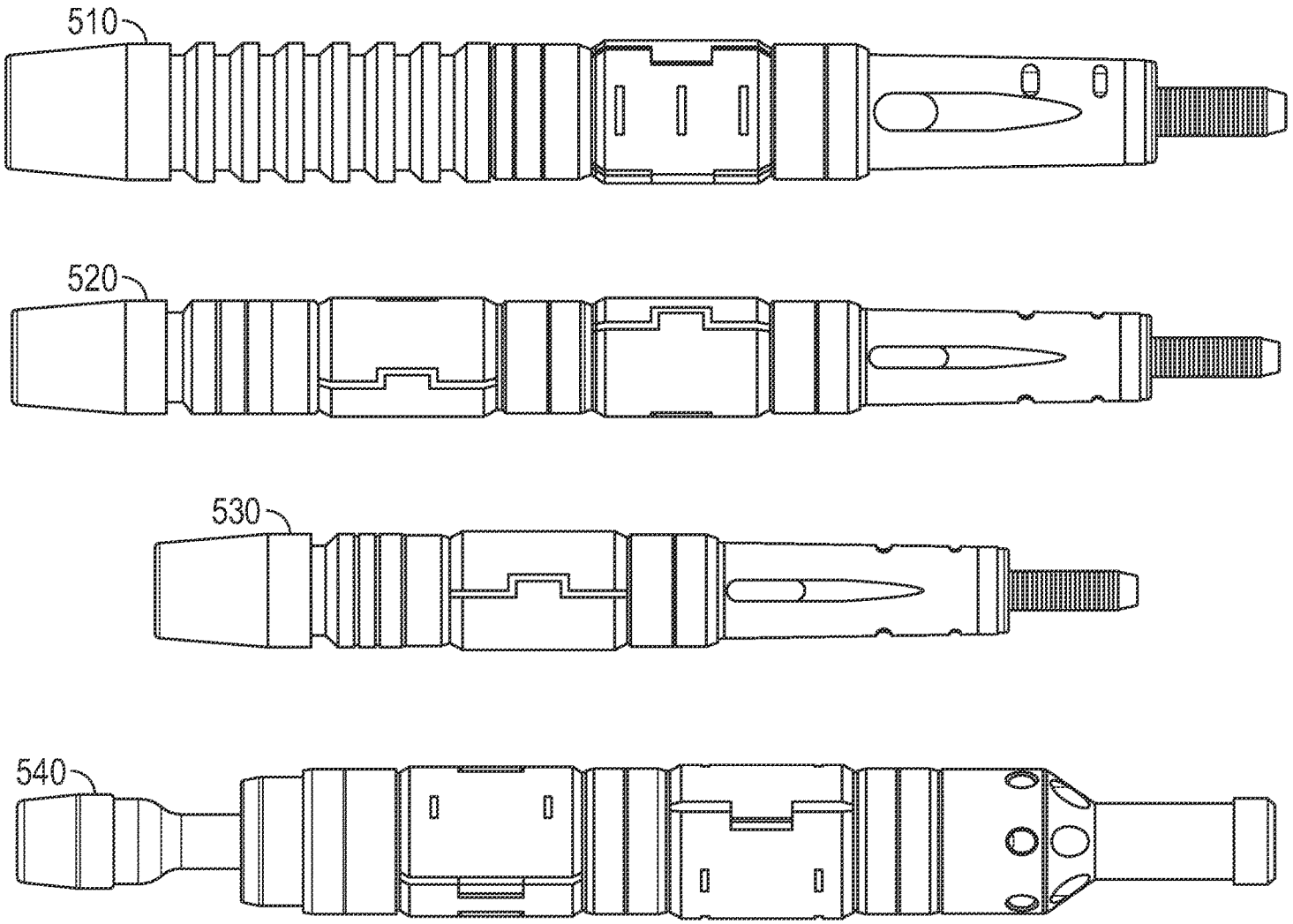
FIG. 5 shows exemplary downhole tools capable of utilizing embodiments detailed herein.

FIG. 5 shows exemplary downhole tools capable of utilizing embodiments of the affixing methods detailed herein. Downhole tool 510 is an example bypass-single pad plunger that may utilize one or more crimples as described above with reference to FIGS. 1 to 4C. Downhole tool 520 is an example bypass-dual pad plunger that may utilize one or more crimples as described above with reference to FIGS. 1 to 4C. Downhole tool 530 is an example bypass-shorty plunger that may utilize one or more crimples as described above with reference to FIGS. 1 to 4C. Downhole tool 540 is an example bypass-sliding sleeve plunger that may utilize one or more crimples as described above with reference to FIGS. 1 to 4C. Of course, there are many other downhole tools that could be assembled or partially assembled with crimples as disclosed herein where a portion of a first body overlying a relieved area on an underlying second body is crimped to form a crimple.

Figure 6:
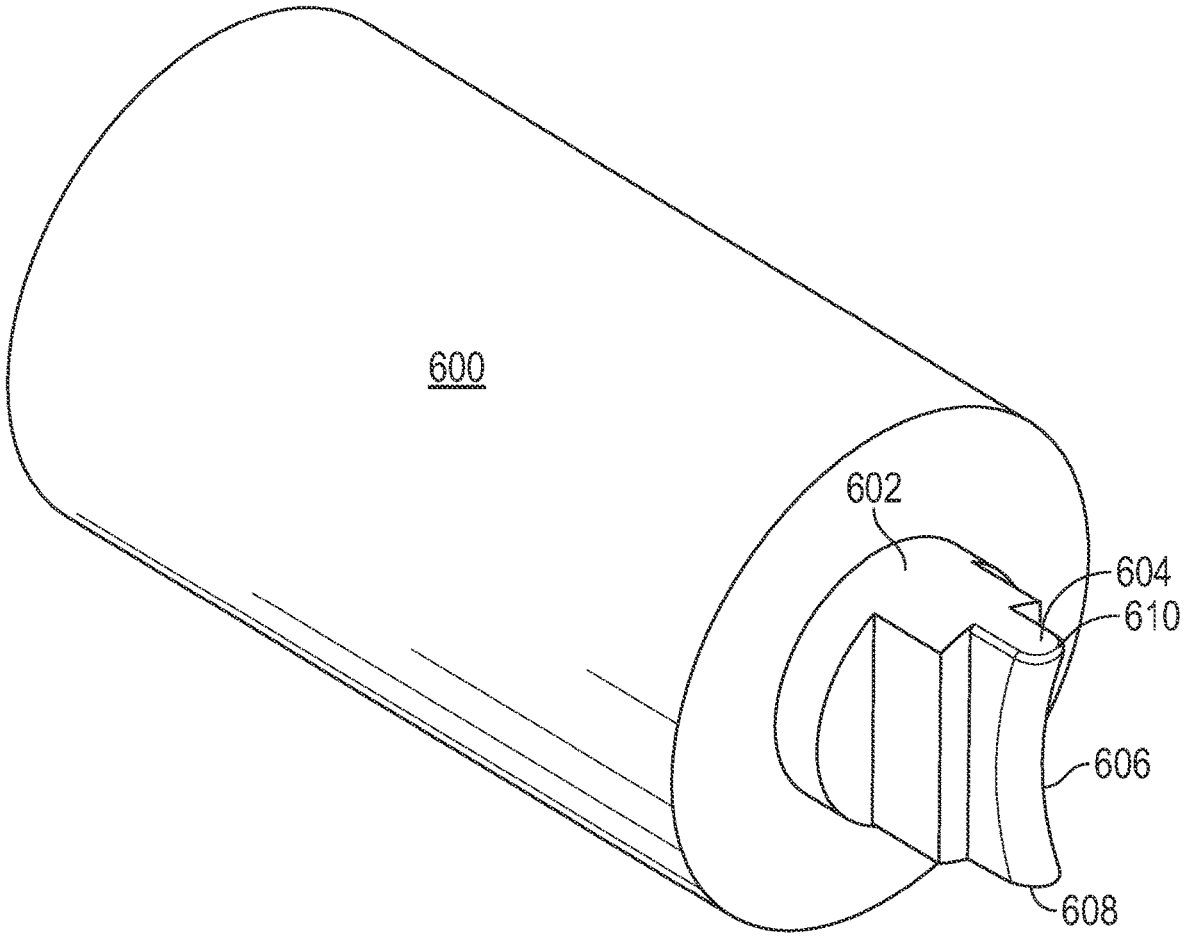
FIG. 6 illustrates an exemplary die for use in a press to form a deformation or a crimple.

FIG. 6 illustrates an exemplary die for use in a press to form a crimple. The body 600 of the die includes a reduced diameter shank 602 that is shaped at its end to form the crimples 410 in the outer surface of the retaining ring 110 of the downhole tool 100. The crimples 410 are shown in detail in FIGS. 4A, 4B, and 4C. The crimples 410, which are indentations into the outer surface of the retaining ring 110, are produced by the shape of the crimple blade 604. The crimple blade 604 includes a major radius 606, a minor radius 608, and a fillet radius 610. The major radius 606 shapes the blade 604 to the radius of the retaining ring 110 at the groove 112. In some embodiments, the major radius 606 is formed to a radial dimension slightly larger than the body of the retaining ring 110 or downhole tool on which the crimple is to be formed. Thus, when the blade 604 contacts the retaining ring 110 or downhole tool and begins to form the crimple 410, the stresses produced in the metal retaining ring 110 or downhole tool tend to cause the material under the blade 604 to flow outward, forming a smooth crimple 410. In alternate embodiments, the major radius 606 of the blade 604 may be substantially the same as or smaller than the radial dimension of the retaining ring 110 or downhole tool. Different retaining ring 110 or downhole tool diameters may require separate dies having different major radii 606 appropriate for each retaining ring 110 or downhole tool.

The minor radius 608 is provided for a similar reason—to allow the stresses of formation of a crimple to cause the material underlying the blade 604 flow outward along the work piece (e.g., the retaining ring or downhole tool). A small fillet radius 610 is provided on the outside edges of the blade 604 to reduce stress riser occurrence.

Figure 7:
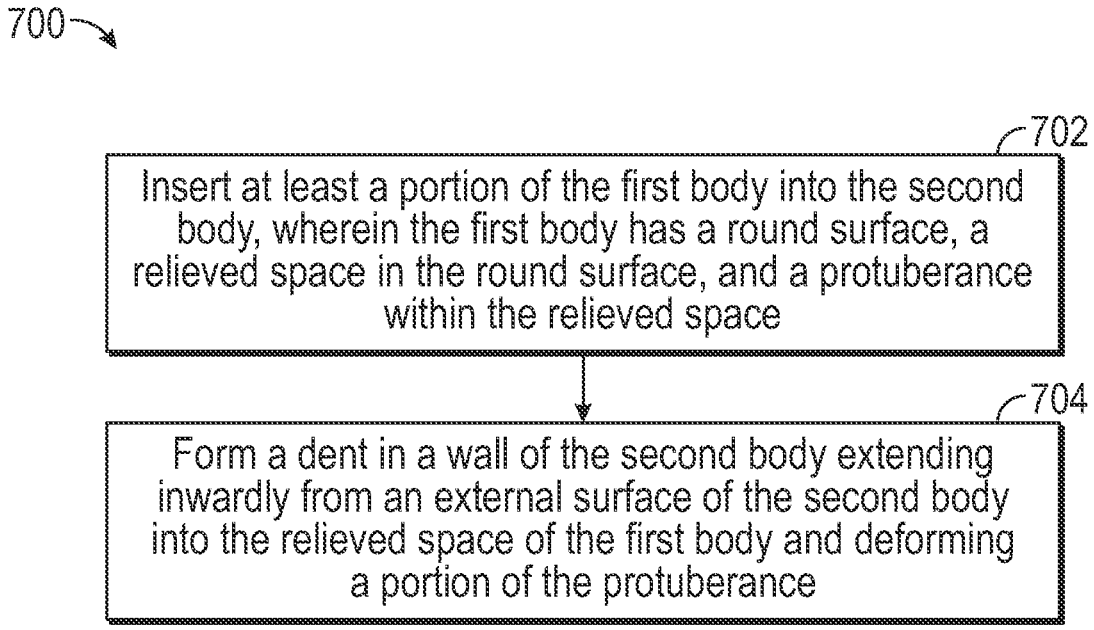
FIG. 7 is a flowchart of steps to secure a first body to a second body.

FIG. 7 is a flowchart of steps of a method of securing a first body to a second body. The first body may be, for example, the central body 126 (see FIG. 1) of the downhole tool 100, and the second body may be, for example the retaining ring 110.

At block 702, operations 700 begin with inserting at least a portion of the first body into the second body, wherein the first body has a rounded or cylindrical surface, a relieved space in the rounded or cylindrical surface, and a protuberance within the relieved space.

At block 704, operations 700 continue with forming a dent in a wall of the second body to cause a portion of the material of the second body to extend inwardly into the relieved space of the first body and to deform a portion of the protuberance.

Conditional language, such as, "can," "could," "might," or "may," unless specifically stated otherwise, or otherwise understood within the context as used, is generally intended to convey that certain implementations could, but do not necessarily, include certain features and/or elements while other implementations may not. Thus, such conditional language generally is not intended to imply that features and/or elements are in any way required for one or more implementations or that one or more implementations necessarily include these features and/or elements. It is also intended that, unless expressly stated, the features and/or elements presented in certain implementations may be used in combination with other features and/or elements disclosed herein.

The specification and annexed drawings disclose example embodiments of the present disclosure. Detail features shown in the drawings may be enlarged herein to more clearly depict the feature. Thus, several of the drawings are not precisely to scale. Additionally, the examples illustrate various features of the disclosure, but those of ordinary skill in the art will recognize that many further combinations and permutations of the disclosed features are possible. Accordingly, various modifications may be made to the disclosure without departing from the scope or spirit thereof. Further, other embodiments may be apparent from the specification and annexed drawings, and practice of disclosed embodiments as presented herein. Examples disclosed in the specification and the annexed drawings should be considered, in all respects, as illustrative and not limiting. Although specific terms are employed herein, they are used in a generic and descriptive sense only, and not intended to the limit the present disclosure.

What is claimed is:

1. A downhole tool, comprising:

a body having a rounded or cylindrical surface, at least one relieved space in the rounded or cylindrical surface, and a protuberance within the at least one relieved space;

a retaining device;

one or more crimples, each crimple including a portion of the material of the retaining device that extends inward into a corresponding portion of the relieved space of the body and which deforms the protuberance within the corresponding portion of the relieved space.

2. The downhole tool of claim 1, wherein the protuberance comprises a circular ring of material that extends radially outward from the body within the relieved space.

3. The downhole tool of claim 1, wherein the one or more crimples each comprise a deformation in a wall of the retaining device that presses against an underlying deformed portion of the protuberance in the relieved space to prevent the retaining device from moving with respect to the body.

4. The downhole tool of claim 1, further comprising a plurality of pads having tabs, wherein the retaining device functions to retain at least a portion of the pads adjacent the body.

5. The downhole tool of claim 1, wherein the protuberance has two sides which meet at an angle of between 40° and 135°.

6. The downhole tool of claim 1, wherein sides of the relieved space have an angle between the sides in a range of 40° to 120°.

7. A method for securing a first body to a second body, comprising:

inserting at least a portion of the first body into the second body, wherein the first body has a rounded or cylindrical surface, a relieved space in the rounded or cylindrical surface, and a protuberance within the relieved space; and deforming a portion of the second body such that material of the second body extends inwardly into an underlying portion of the relieved space of the first body and such that the inwardly extending material of the second body deforms an underlying portion of the protuberance on the first body to affix the first body to the second body.

8. The method of claim 7, wherein the protuberance comprises a circular ring of material that extends radially outward from the first body.

9. The method of claim 7, wherein the protuberance has two sides which meet at an angle of between 40° and 135°.

10. The method of claim 7, wherein sides of the relieved space have an angle between the sides in a range of 40° to 120°.

11. The method of claim 7, wherein deforming a portion of the second body comprises pressing a die into an external surface of the second body.

12. The method of claim 11, wherein deforming a portion of the second body further comprises supporting the second body in a block prior to pressing the die into the external surface of the second body.

13. The method of claim 7, wherein the second body comprises a generally cylindrical outer surface having a circular groove therein, and wherein deforming a portion of the second body comprises pressing a die with a concave shaped blade into a portion of the circular groove.

* * * * *